US008006871B2

(12) United States Patent
Chen

(10) Patent No.: US 8,006,871 B2
(45) Date of Patent: Aug. 30, 2011

(54) LIQUID-DISPENSING DEVICE

(75) Inventor: Cheng-Chang Chen, Taipei Hsien (TW)

(73) Assignee: Bobson Hygiene Internation Inc. (TW)

( * ) Notice: Subject to any disclaimer, the term of this patent is extended or adjusted under 35 U.S.C. 154(b) by 616 days.

(21) Appl. No.: 12/079,213

(22) Filed: Mar. 25, 2008

(65) Prior Publication Data

US 2009/0159616 A1 Jun. 25, 2009

(30) Foreign Application Priority Data

Dec. 25, 2007 (TW) ..... 96149886 A

(51) Int. Cl.
*B67D 1/00* (2006.01)

(52) U.S. Cl. ..... 222/214; 417/477.1; 222/333

(58) Field of Classification Search ..... 222/1–2, 222/60, 63, 95–96, 261–263, 325, 339, 212–214, 222/333; 417/474–481
See application file for complete search history.

(56) References Cited

U.S. PATENT DOCUMENTS

| | | | | |
|---|---|---|---|---|
| 6,036,056 | A * | 3/2000 | Lee et al. | 222/63 |
| 2005/0189375 | A1 * | 9/2005 | Mcgill | 222/1 |
| 2006/0243740 | A1 * | 11/2006 | Reynolds et al. | 222/52 |
| 2007/0215644 | A1 * | 9/2007 | Otis et al. | 222/205 |

* cited by examiner

*Primary Examiner* — Kevin P Shaver
*Assistant Examiner* — Andrew Bainbridge
(74) *Attorney, Agent, or Firm* — Schwegman, Lundberg & Woessner, P.A.

(57) ABSTRACT

A liquid-dispensing device includes a liquid-containing unit, a flexible tube, a nozzle, and a cam mechanism. The flexible tube is connected to the liquid-containing unit. The nozzle is connected to the flexible tube. The cam mechanism includes first and second cams, and first and second cam followers. The first and second cams are co-rotatable. Each of the first and second cam followers is driven by a respective one of the first and second cams to move to a squeezing position, where each of the first and second cam followers exerts a squeezing force on the flexible tube.

7 Claims, 8 Drawing Sheets

LIQUID-DISPENSING DEVICE

BACKGROUND OF THE INVENTION

1. Field of the Invention

This invention relates to a liquid-dispensing device, more particularly to liquid-dispensing device that has a relatively small physical size.

2. Description of the Related Art

FIG. 1 illustrates a conventional liquid-dispensing device 9 that includes a liquid-containing unit 91, a flexible tube 92, a nozzle 93, first and second squeezing members 94, 95, and first and second driving mechanisms (not shown). The liquid-containing unit 91 serves to store liquid 90 therein. The flexible tube 92 is connected to the liquid-containing unit 91. The nozzle 93 is connected to the flexible tube 92. Each of the first and second squeezing members 94, 95 is movable to a squeezing position, where each of the first and second squeezing members 94, 95 exerts a squeezing force on the flexible tube 92. Each of the first and second driving mechanisms drives movement of a respective one of the first and second squeezing members 94, 95 to the squeezing position.

In operation, the first driving mechanism is first operated to drive movement of the first squeezing member 94 to the squeezing position. As a result, a portion of the liquid 90 in the flexible tube 92 is prevented from flowing back into the liquid-containing unit 91. Thereafter, the second driving mechanism is operated to drive movement of the second squeezing member 95 to the squeezing position, and consequently, the portion of liquid 90 in the flexible tube 92 flows out of the nozzle 93.

The aforementioned conventional liquid-dispensing device 9 is disadvantageous in that, since it includes two independent driving mechanisms, i.e., the first and second driving mechanisms, the conventional liquid-dispensing device 9 is bulky and difficult to assemble.

SUMMARY OF THE INVENTION

Therefore, the object of the present invention is to provide a liquid-dispensing device that can overcome the aforesaid drawback of the prior art.

According to the present invention, a liquid-dispensing device comprises a liquid-containing unit, a flexible tube, a nozzle, and a cam mechanism. The flexible tube is connected to the liquid-containing unit. The nozzle is connected to the flexible tube. The cam mechanism includes first and second cams, and first and second cam followers. The first and second cams are co-rotatable. Each of the first and second cam followers is driven by a respective one of the first and second cams to move to a squeezing position, where each of the first and second cam followers exerts a squeezing force on the flexible tube.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
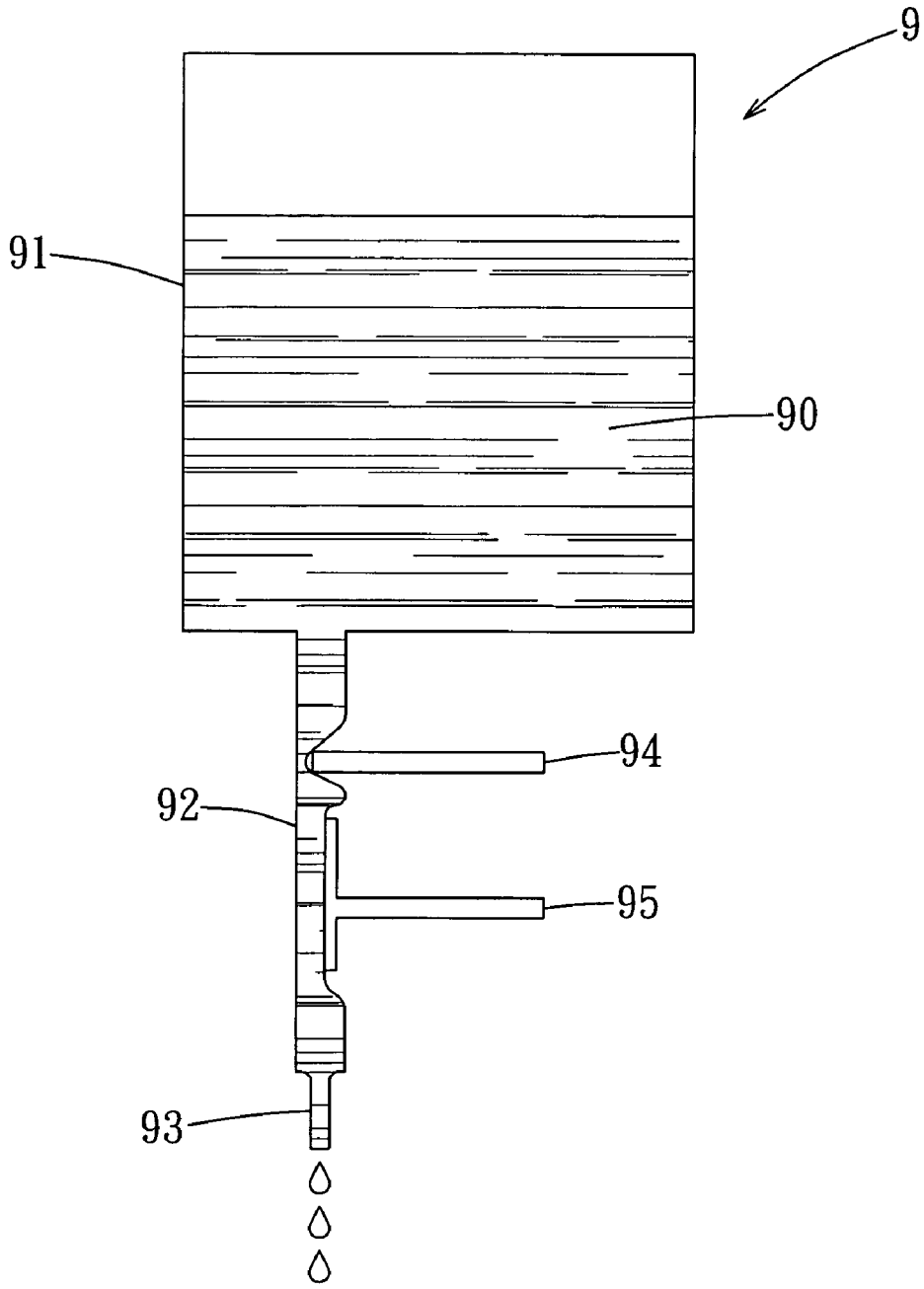
FIG. 1 PRIOR ART
FIG. 1 is a schematic view illustrating a liquid-containing unit, a flexible tube, a nozzle, and a pair of squeezing members of a conventional liquid-dispensing device.
Figure 2:
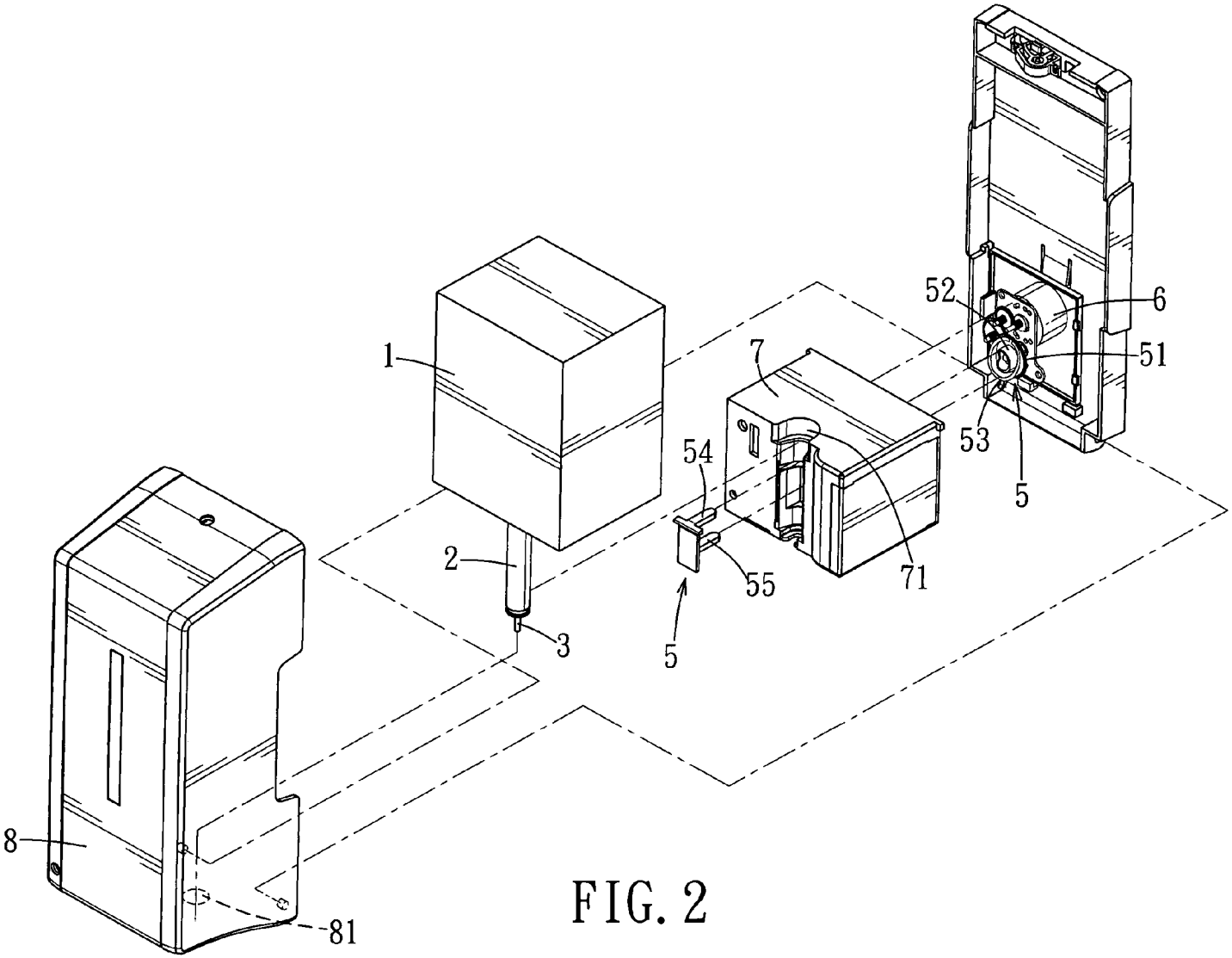
FIG. 2 is an exploded perspective view of the preferred embodiment of a liquid-dispensing device according to this invention.

Referring to FIG. 2, the preferred embodiment of a liquid-dispensing device according to this invention is shown to include a liquid-containing unit 1, a flexible tube 2, a nozzle 3, and a cam mechanism 5.

The liquid-containing unit 1 serves to store liquid (not shown) therein.

The flexible tube 2 is connected to the liquid-containing unit 1.

The nozzle 3 is connected to the flexible tube 2, and prevents the liquid in the flexible tube 2 from flowing out when the flexible tube 2 is not squeezed.

Figure 3:
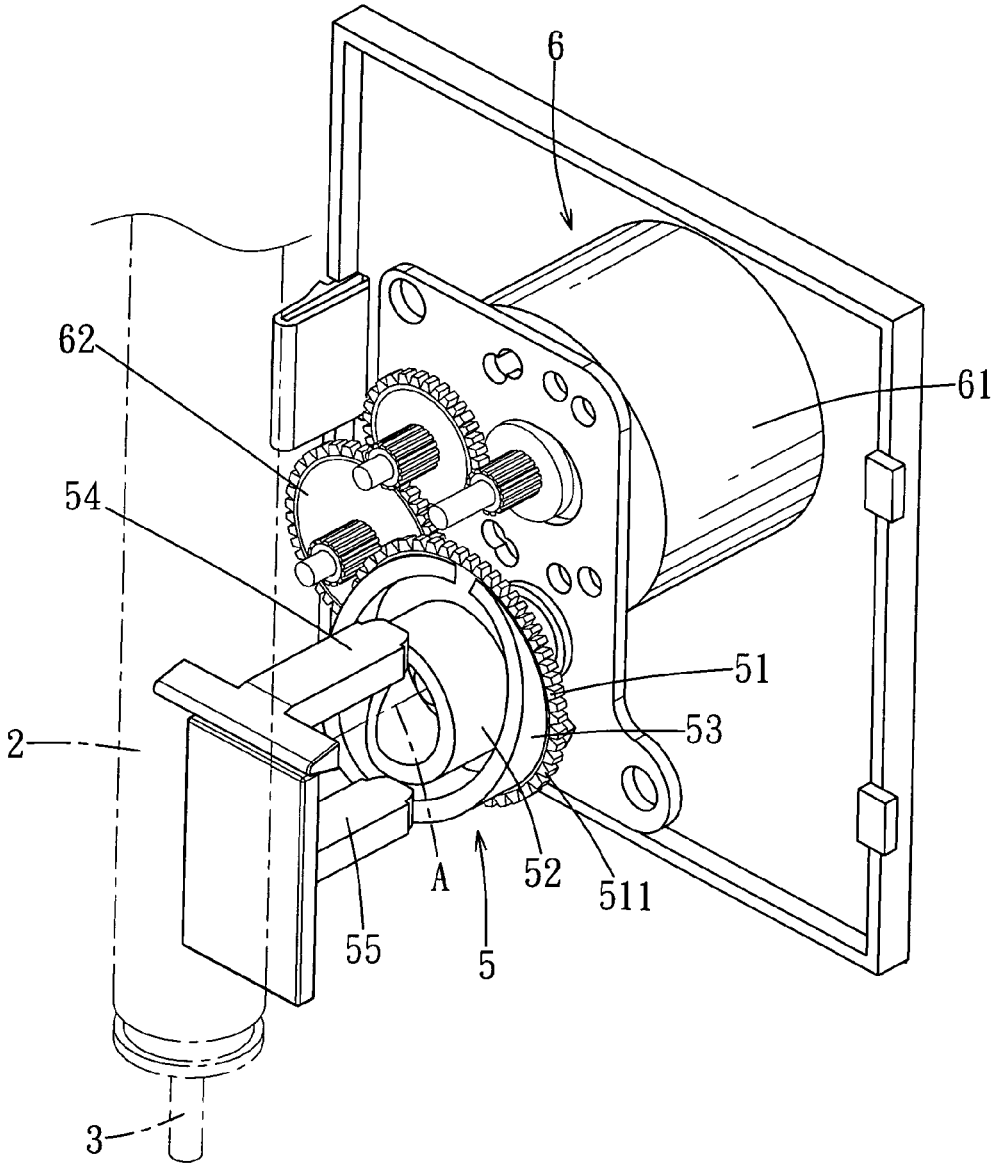
FIG. 3 is a perspective view illustrating a flexible tube, a nozzle, a cam mechanism, and a driving unit of the preferred embodiment.
Figure 4:
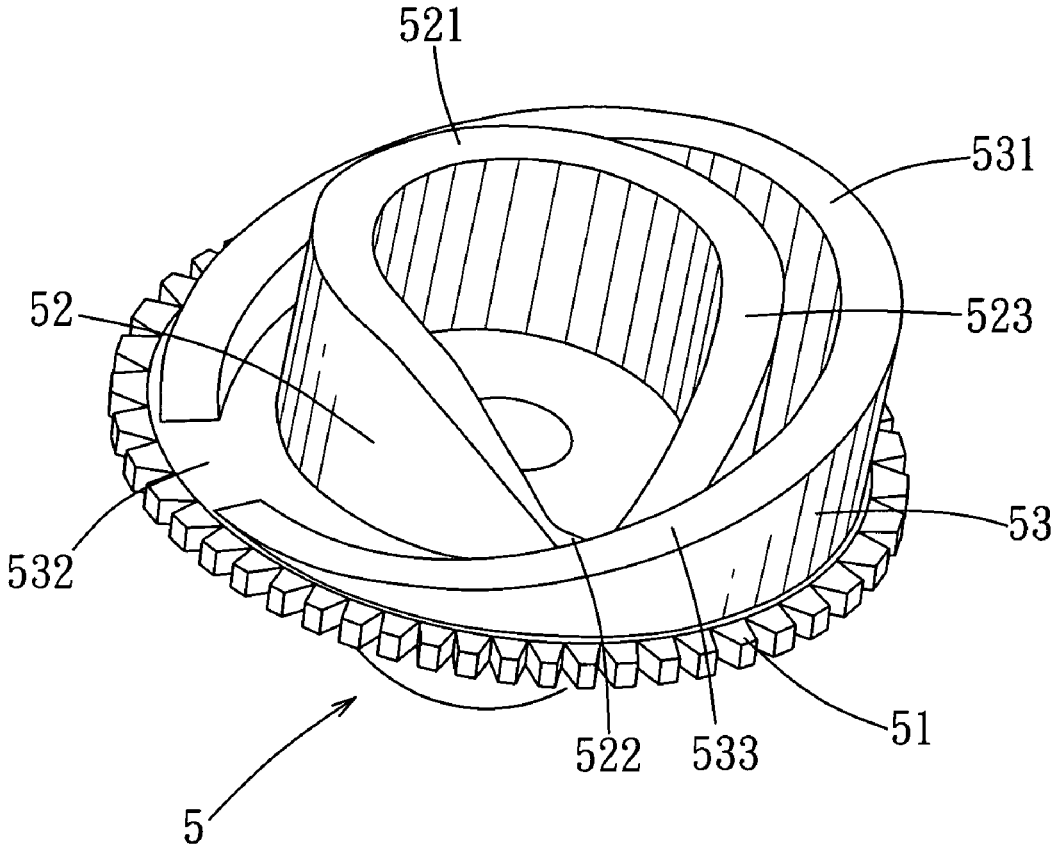
FIG. 4 is a perspective view illustrating a rotatable base, and first and second cams of the cam mechanism of the preferred embodiment.

With further reference to FIGS. 3 and 4, the cam mechanism 5 includes a rotatable base 51, first and second cams 52, 53, and first and second cam followers 54, 55.

The base 51 defines an axis of rotation (A), and has opposite first and second surfaces, and a third surface that interconnects the first and second surfaces and that is formed with gear teeth 511. In this embodiment, the base 51 is rotatable about the axis of rotation (A) to first, second, and third angular positions.

The first cam 52 is formed on and extends axially from the first surface of the base 51 so as to be co-rotatable therewith about the axis rotation (A). In this embodiment, the first cam 52 surrounds the axis of rotation (A), and has first and second cam segments 521, 522, and an intermediate segment 523 that interconnects the first and second segments 521, 522 thereof and that extends inclinedly to the axis of rotation (A). Moreover, in this embodiment, the first segment 521 of the first cam 52 extends transversely to the axis of rotation (A).

The second cam 53 is formed on and extends axially from the first surface of the base 51 so as to be co-rotatable therewith about the axis of rotation (A). In this embodiment, the second cam 53 surrounds the first cam 52, and has first and second cam segments 531, 532, and an intermediate segment 533 that interconnects the first and second segments 531, 532 thereof and that extends inclinedly to the axis of rotation (A). Moreover, in this embodiment, the second segment 532 of second cam 53 is level with the first surface of the base 51.

Each of the first and second cam followers 54, 55 is driven by a respective one of the first and second cams 52, 53 to move to a squeezing position, where each of the first and second cam followers 54, 55 exerts a squeezing force on the flexible tube 2. In this embodiment, the first cam follower 54 has a T-shaped cross-section along a horizontal plane perpendicular to the flexible tube 2, and the second cam follower 55 has a T-shaped cross-section along a vertical plane parallel to the flexible tube 2.

Figure 5:
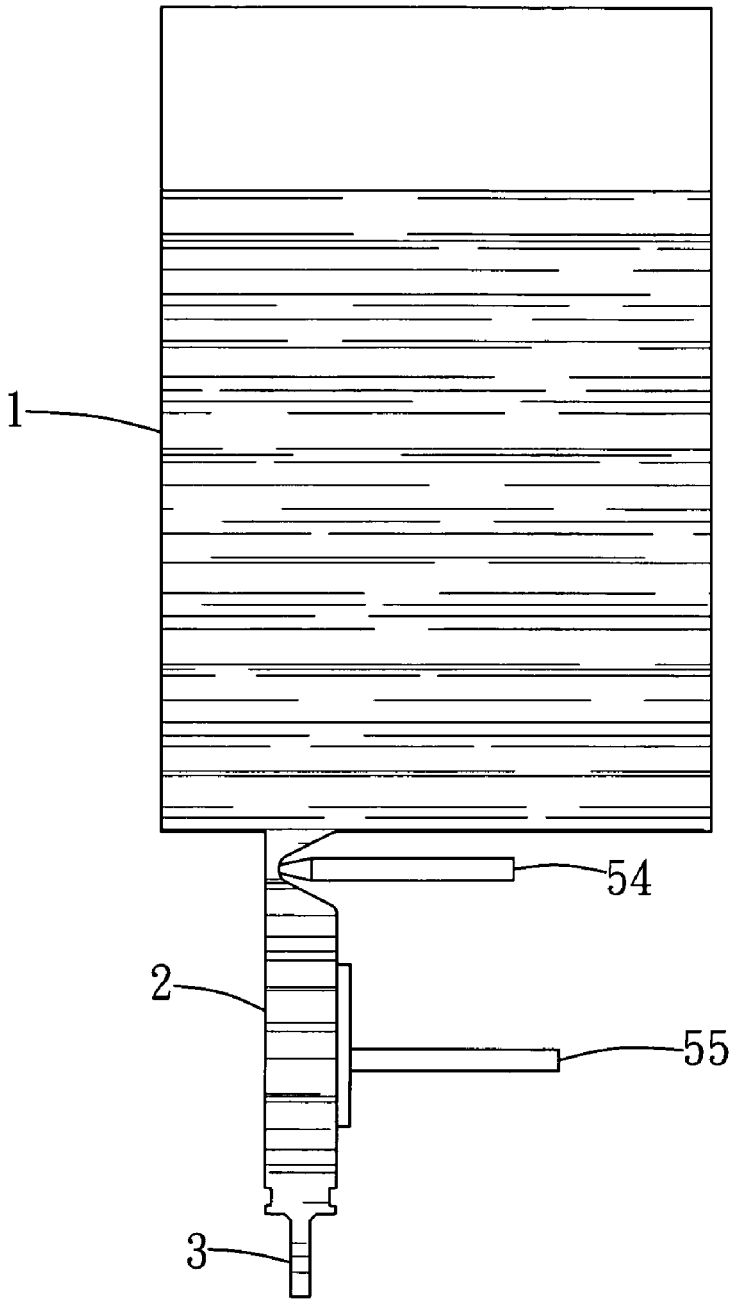
FIGS. 5 to 7 are schematic views illustrating operation of the preferred embodiment.
Figure 6:
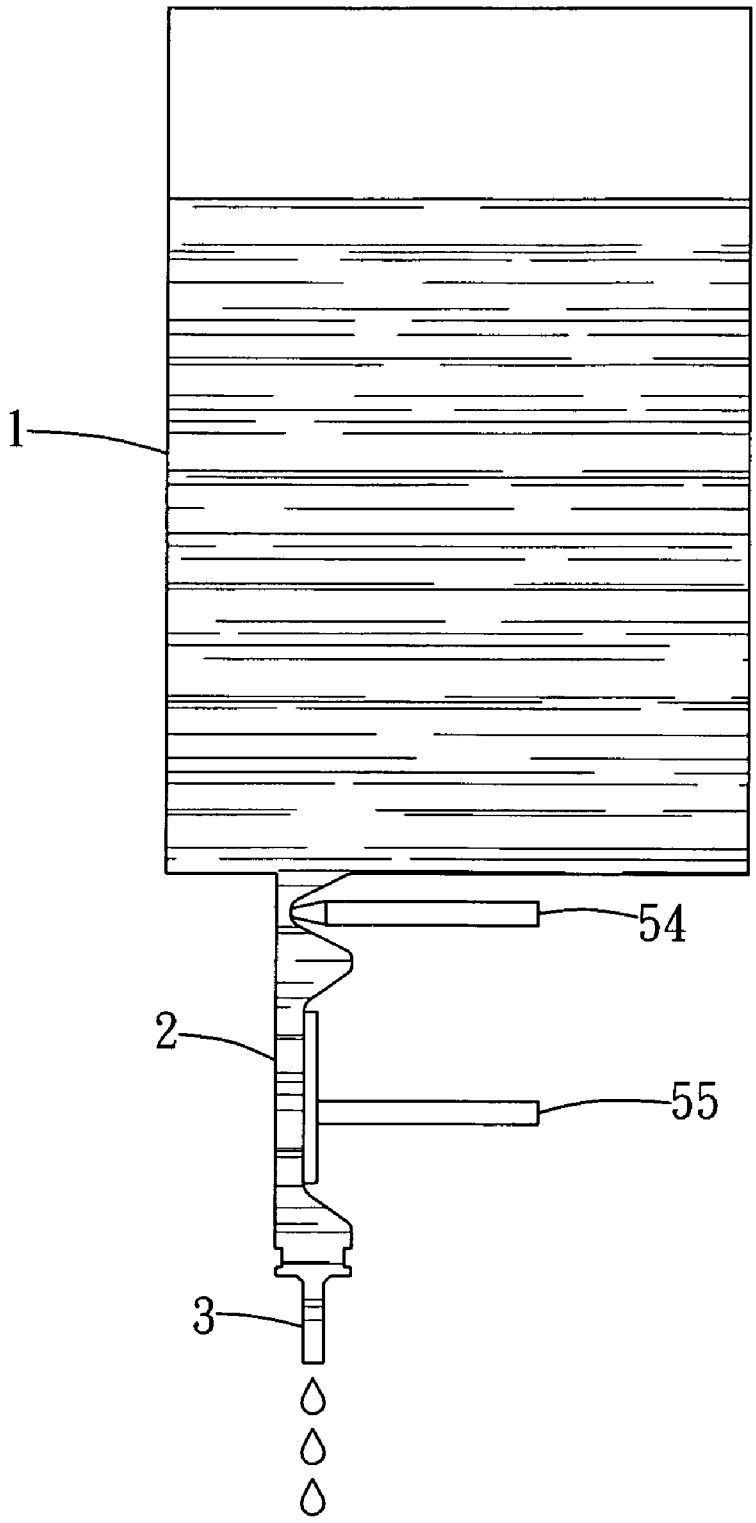
Figure 7:
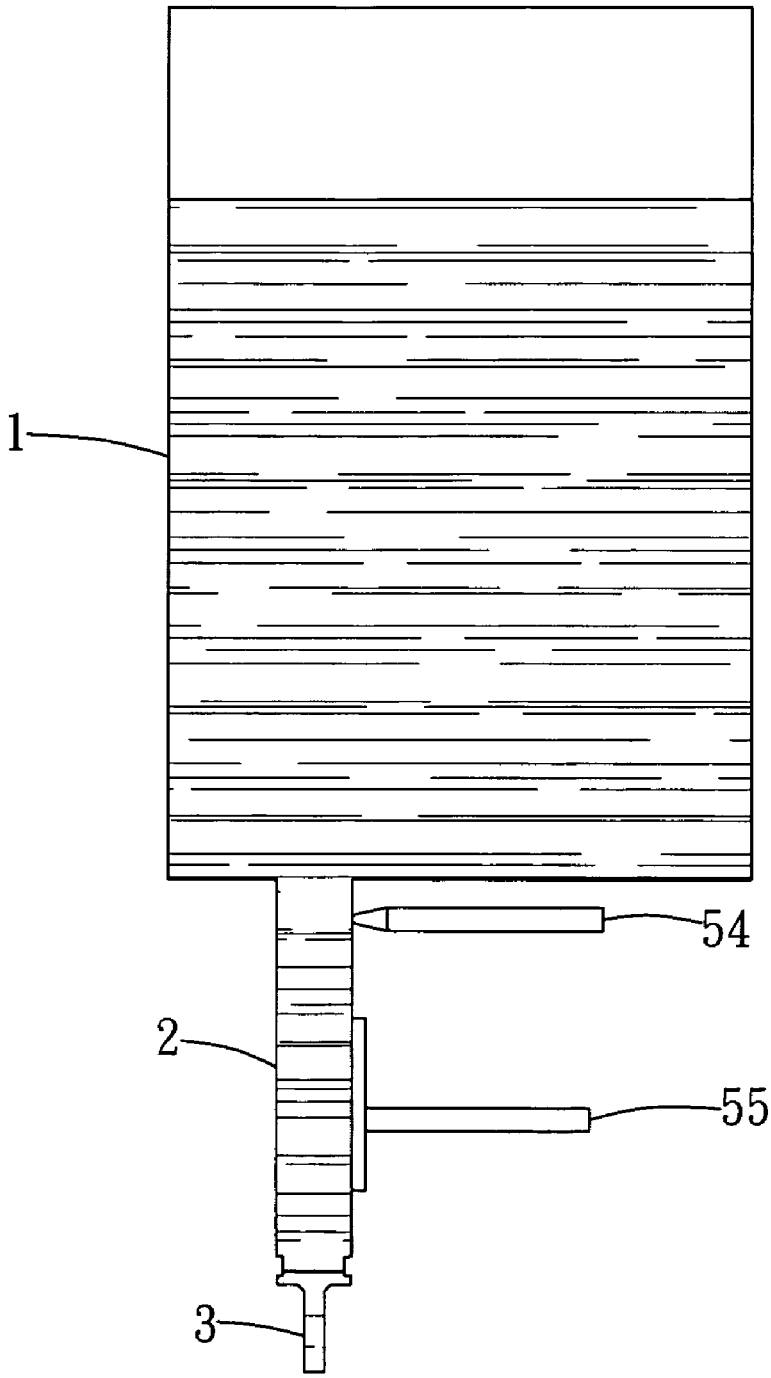

In operation, at an initial position, where the intermediate segment 523 of the first cam 52 and the second segment 532 of the second cam 53 respectively abut against the first and second cam followers 54, 55, when the base 51 is rotated to the first angular position, the first segment 521 of the first cam 52 abuts against the first cam follower 54, thereby permitting the first cam 52 to drive movement of the first cam follower 54 to the squeezing position. Consequently, as illustrated in FIG. 5, the liquid in the flexible tube 2 is prevented from flowing back into the liquid-containing unit 1. It is noted that, at this position, the intermediate segment 533 of the second cam 53 abuts against the second cam follower 55. Thereafter, when the base 51 is rotated to the second angular position, the first segment 531 of the second cam 53 abuts against the second cam follower 55, thereby permitting the second cam 53 to drive movement of the second cam follower 55 to the squeezing position. Hence, as illustrated in FIG. 6, the liquid in the flexible tube 2 flows out of the nozzle 3. It is noted that, at this position, the first segment 521 of the first cam 52 still abuts against the first cam follower 54. Thereafter, when the base 51 is rotated to the third angular position, the second segment 522 of the first cam 52 and the intermediate segment 533 of the second cam 53 respectively align with the first and second cam followers 54, 55, thereby releasing the squeezing forces exerted by the first and second cam followers 54, 55 on the flexible tube 2 and permitting the flexible tube 2 to snap back to its original shape and to push the first and second cam followers 54, 55 such that the first and second cam followers 54, 55 respectively abut against the second segment 522 of the first cam 52 and the intermediate segment 533 of the second cam 53.

The liquid-dispensing device further includes a driving unit 6 for driving rotation of the base 51 of the cam mechanism 5 to the first, second, and third angular positions. In particular, the driving unit 6 includes a gear assembly 62 coupled to the gear teeth 511 of the base 51 of the cam mechanism 5, and a motor 61 coupled to the gear assembly 62 thereof.

The liquid-dispensing device further includes a restricting seat 7 for preventing movement of the flexible tube 2. In particular, the restricting seat 7 defines a groove 71 that corresponds to a shape of the flexible tube 2 and that receives snugly the flexible tube 2 therein. The restricting seat 7 is formed with a pair of through-holes (not shown), each of which is in spatial communication with the groove 71 therein. Each of the first and second cam followers 54, 55 of the cam mechanism 5 extends through a respective one of the through-holes in the restricting seat 7.

Figure 8:
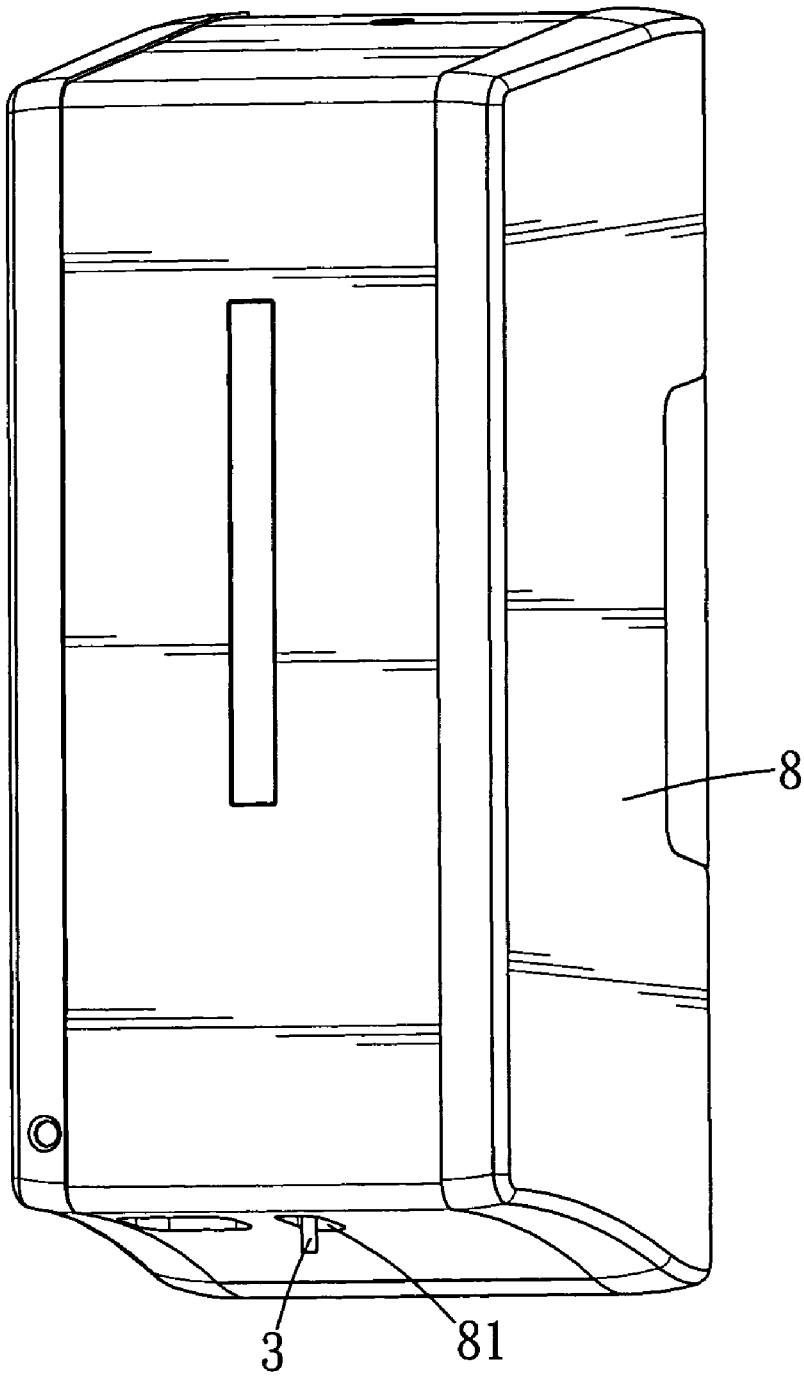
FIG. 8 is a perspective view illustrating a housing of the preferred embodiment.

With further reference to FIG. 8, the liquid-dispensing device further includes a housing 8. The liquid-containing unit 1, the flexible tube 2, the cam mechanism 5, the driving unit 6, and the restricting seat 7 are disposed in the housing 8. The nozzle 3 extends through an opening 81 in the housing 81.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A liquid-dispensing device, comprising:
a liquid-containing unit;
a flexible tube connected to said liquid-containing unit;
a nozzle connected to said flexible tube; and
a cam mechanism including
first and second cams that are co-rotatable,
first and second cam followers, each of which is driven by a respective one of said first and second cams to move to a squeezing position, where each of said first and second cam followers exerts a squeezing force on said flexible tube, and
a rotatable base that defines an axis of rotation, said first and second cams being formed on and extending axially from said base so as to be co-rotatable therewith about the axis of rotation,
said first cam having first and second segments, and an intermediate segment that interconnects said first and second segments thereof and that extends inclinedly to the axis of rotation.

2. The liquid-dispensing device as claimed in claim 1, wherein said first segment of said first cam extends transversely to said axis of rotation.

3. A liquid-dispensing device, comprising:
a liquid-containing unit;
a flexible tube connected to said liquid-containing unit;
a nozzle connected to said flexible tube; and
a cam mechanism including
first and second cams that are co-rotatable,
first and second cam followers, each of which is driven by a respective one of said first and second cams to move to a squeezing position, where each of said first and second cam followers exerts a squeezing force on said flexible tube, and
a rotatable base that defines an axis of rotation, said first and second cams being formed on and extending axially from said base so as to be co-rotatable therewith about the axis of rotation, said second cam having first and second segments, and an intermediate segment that interconnects said first and second segments thereof and that extends inclinedly to the axis of rotation.

4. The liquid-dispensing device as claimed in claim 3, wherein said first segment of said second cam extends transversely to said axis of rotation.

5. The liquid-dispending device as claimed in claim 1, further comprising a driving unit for driving rotation of said base of said cam mechanism.

6. The liquid-dispensing device as claimed in claim 5, wherein said driving unit includes a gear assembly coupled to said base of said cam mechanism, and a motor coupled to said gear assembly thereof.

7. The liquid-dispensing device as claimed in claim 6, further comprising a housing, said liquid-containing unit,
said flexible tube, said cam mechanism, and said driving unit being disposed in said housing,
said nozzle extending through said housing.

* * * * *